US007857662B2

(12) United States Patent
Gillespie et al.

(10) Patent No.: US 7,857,662 B2
(45) Date of Patent: Dec. 28, 2010

(54) RECEPTACLE CAGE AND METHOD FOR MAKING THE SAME

(75) Inventors: Brian J. Gillespie, Harrisburg, PA (US); Chun-Hsiung Hsu, Tu-Cheng (TW); Xin-Jie Zhang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/460,135

(22) Filed: Jul. 13, 2009

(65) Prior Publication Data

US 2010/0079971 A1 Apr. 1, 2010

Related U.S. Application Data

(63) Continuation-in-part of application No. 12/286,599, filed on Sep. 30, 2008, now Pat. No. 7,591,680.

(51) Int. Cl.
*H01R 13/648* (2006.01)

(52) U.S. Cl. ..... 439/607.3; 385/62; 439/607.2; 439/607.27; 439/939

(58) Field of Classification Search ..... 439/92, 439/95, 108, 607.17, 607.19, 607.2, 607.27, 439/607.28, 607.3, 939; 385/92
See application file for complete search history.

(56) References Cited

U.S. PATENT DOCUMENTS 3,099,238 A * 7/1963 Barger ..... 228/137
6,478,622 B1 * 11/2002 Hwang ..... 439/607.2
6,517,382 B2 2/2003 Flickinger
7,347,711 B1 3/2008 Bianchini
7,530,845 B1 * 5/2009 Yang ..... 439/607.01
7,591,680 B2 * 9/2009 Zhang et al. ..... 439/607.38
2008/0096429 A1 * 4/2008 Mikolajczak et al. .. 439/620.08
2010/0079971 A1 * 4/2010 Gillespie et al. ..... 361/816

* cited by examiner

*Primary Examiner*—James Harvey
(74) *Attorney, Agent, or Firm*—Ming Chieh Chang; Wei Te Chung; Andrew C. Cheng

(57) ABSTRACT

A receptacle cage (100) for receiving a small form-factor pluggable (SFP) transceiver therein includes a cage body (10) inserted into a passage (201) defined in a chassis (200), and a conductive plate (21) attached to outside of the cage body (10), said conductive plate (21) forming a plurality of resilient fingers (26) for grounding said cage body (10) to said chassis (200). The conductive plate (21) forming a front edge portion (282) closed to the cage body (10), a connection portion (284) extending slantways and rearwardly from the front edge portion (282), and the plurality of resilient fingers (26) being listed side by side in a first direction and extending from the connection portion (284), wherein said connection portion (284) extends continuously in a direction perpendicular to the first direction and parallel to corresponding wall of the cage body (10).

14 Claims, 6 Drawing Sheets

RECEPTACLE CAGE AND METHOD FOR MAKING THE SAME

CROSS REFERENCE TO RELATED APPLICATION

This application is a continuation-in-part of Ser. No. 12/286,599 filed on Sep. 30, 2008 now U.S. Pat. No. 7,591,680 entitled "Receptacle cage" assigned to the common assignee of the current patent application.

BACKGROUND OF THE INVENTION

1. Field of the Invention

The present invention relates to a receptacle cage, and more particularly to a receptacle cage with a detachable front collar facilitating robust EMI shielding when the cage is mounted onto a printed circuit board with the front boot extending out of a window of a panel.

2. Description of the Prior Art

Historically, electrical and opto-electric modules have been connected to printed circuit boards with solder pins. Conventional approaches for soldering the pins to the circuit board include reflow soldering and hand soldering. Although solder reflow is an effective technique for electrically connecting a module to a circuit board, the heat required to achieve reflow tends to be detrimental to heat sensitive components within the module, such as plastic optical components which tend to warp or otherwise distort at high temperatures. Furthermore, to ensure that modules are capable of withstanding the environmental conditions associated with reflow soldering, the industry utilizes high temperature materials that add cost to the modules. Since most modules will be used in more moderate climates (e.g., an air-conditioned office building), the modules are therefore "over-engineered" simply to ensure that they can withstand the reflow soldering process.

To avoid exposing the module to harsh conditions during reflow soldering, often electronic modules are hand soldered instead to a printed circuit board. The need for hand soldering, however, dramatically increases the cost of system comprising such modules.

Aside from the problems associated with soldering the module to the circuit board, there is the added inconvenience that, if a single module fails on a circuit board, which may support many such modules, the entire circuit board must be removed for service.

Therefore, there is a need for a solderless connection of a module to a circuit board. To this end, several pluggable module designs and standards have been introduced in which a pluggable module plugs into a receptacle which is electronically connected to a host circuit board. For example, a well-known type of transceiver developed by an industry consortium is known as a gigabit interface converter (GBIC) or serial optical converter (SOC) and provides an interface between a computer and a data communication network such as Ethernet or Fibre Channel. These standards offer a generally robust design which has been well received in industry.

Although these conventional pluggable designs have been used successfully in the past, they tend to be unsuitable for miniaturization which is an ever-constant objective in the industry. It is desirable to miniaturize transceivers in order to increase the port density associated with the network connection, such as, for example, switch boxes, cabling patch panels, wiring closets, and computer I/O. Recently, a new standard has been promulgated and is referred to herein as the small form factor (SFF) standard which specifies an enclosure height of 9.8 mm and a width of 13.5 mm and a minimum of 20 electrical input/output connections. In addition to miniaturizing the module, it is also desirable to increase its operating frequency. For example, applications are quickly moving from the sub-gigabit realm to well over a gigabit. Conventional pluggable module configurations, however, cannot meet these parameters.

Miniaturizing a module while maintaining or even increasing its operating speed, presents a number of design problems particularly in applications in which data transmission rates are high, e.g., in the range of 1-10 Gbs (Gigabits/second). Of particular concern is reducing electromagnetic interference (EMI) emissions. Due to FCC regulations, there is a need not only to minimize the EMI emissions of the module, but also to contain the EMI emissions of the host system in which the module is mounted regardless of whether a module is plugged in to the receptacle. In conventional designs, this EMI shielding was achieved by using conductive spring-loaded door which was capable of swinging shut and closing the receptacle when the module was removed. Conventional receptacles also had spring clips to ground the receptacles to the bezel opening of the host system. Providing space for spring-loaded doors and spring clips on the receptacle tends to be problematic if not impossible in miniaturized configurations. Additionally, the small size presents problems in dissipating heat from the module and incorporating traditional mechanisms for ejecting and retaining the module and for electrically connecting the module to the host circuit board.

U.S. Pat. No. 6,517,382 issued to Flickinger on Feb. 11, 2003 discloses A receptacle for a pluggable module which includes a housing having a front, a back wall, a top wall, a bottom wall, and side walls and defining a cavity for receiving a module. The bottom wall has a bottom opening to receive a receptacle connector, and the front has a front opening to receive the module. The walls of the housing are made from a conductive material. A plurality of elongated members extend down from the housing past the bottom wall. The elongated members are adapted for electrical connection to a host circuit board such that the walls of the housing are electrically connected to the host circuit board. As shown in FIG. 1, a front portion is designed to extend through a window of a panel which was disclosed in the original drawing. The front portion is provided with a plurality of resilient fingers such that those fingers can electrical be electrically connected to the inner edge of the winder so as to provide an EMI shielding.

A small form-factor pluggable transceiver (SFP transceiver) provides a link between an electronic transmission line and an optical transmission line as a bi-direction optical-electronic converter. The SFP transceiver is mounted on a printed circuit board of a host system device via a high-speed connector. Then SFP transceiver and the connector are received in a receptacle cage to avoid EMI.

U.S. Pat. No. 7,347,711 issued to Bianchini on Mar. 25, 2008 discloses a fiber optic connector release mechanism. The fiber optic connector release mechanism is used to release a transceiver module from a cage assembly includes a pivoting bail that operates a slide plate on the transceiver module. The locking mechanism comprises a locking projection on an underside of the module housing which mates with an aperture in a flexible locking tab on an underside of the cage. When the release mechanism is actuated, a flexible lifting tab on the slide plate is urged upward by a trailing edge of the locking projection on an underside of the module housing, which in turn moves the locking tab on the cage upward, thereby disengaging the locking tab from the locking projection.

During manufacturing, the side portion is too small to use spot-welding to attach the side portion to the cage body. The reliability of the EMI shielding provided by the cage cannot be ensured.

Hence, an improved receptacle cage is needed to solve the above problem.

BRIEF SUMMARY OF THE INVENTION

Object of the present invention is to provide a receptacle cage having a conductive plate mounted onto a cage body for firmly grounding the receptacle cage to a chassis.

The present invention provides a receptacle cage mounted on a printed circuit board. The receptacle cage comprises a cage body having a plurality of walls to define an opening for receiving a small form-factor pluggable (SFP) transceiver therein. The cage body has a front end inserted into a passage defined in a chassis, and a conductive plate attached to outside of the cage body at the front end, said conductive plate forming a plurality of resilient fingers for grounding said cage body to said chassis. The conductive plate forming a front edge portion closed to one of the wall of the cage body, a connection portion extending slantways rearwardly from the front edge portion, and the plurality of resilient fingers being listed side by side in a first direction and extending from the connection portion, wherein said connection portion extends continuously in the first direction.

A method for making a receptacle cage is also provided. The method comprises the following steps: (1) providing a cage body having a plurality of walls to define an opening for receiving a small form-factor pluggable (SFP) transceiver therein, the cage body having a front end to be inserted into a passage defined in a chassis; (2) providing a rectangular-shaped collar, said rectangular-shaped collar defined with a plurality of resilient fingers for contacting the chassis in said passage, said rectangular-shaped collar having a plurality conductive plates bent from a planar metal plate, wherein said plurality conductive plates being connected in turn and two conductive plates at opposite ends of said plurality conductive plates being connected to form said rectangular-shaped collar; (3) sheathing said rectangular-shaped collar around said front end of said cage body, wherein the rectangular-shaped collar being fixed there.

An advantage of the present invention provides a receptacle cage having a conductive plate so that the receptacle cage is securely grounded to a chassis and the conductive plate having a connection portion to increase stiffness of the conductive plate.

Another advantage of the present invention provides a method for making a receptacle cage. The rectangular-shaped collar is conveniently manufactured and secured to the cage body of the receptacle cage.

Other objects, advantages and novel features of the invention will become more apparent from the following detailed description of the present embodiments when taken in conjunction with the accompanying drawings.

DETAILED DESCRIPTION OF THE INVENTION

Figure 1:
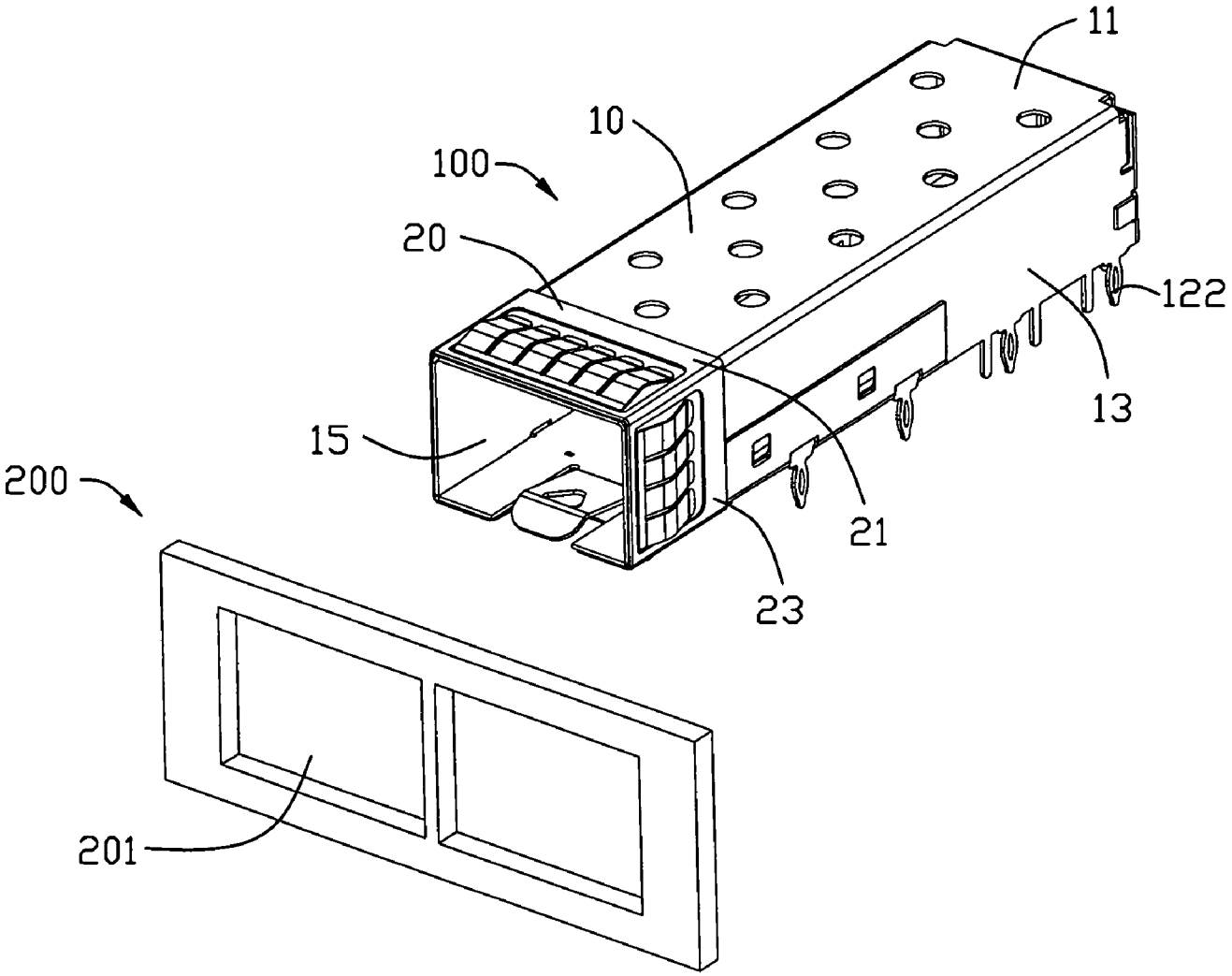
FIG. 1 is an assembled perspective view of a receptacle cage and a chassis on which the receptacle cage will be mounted.
Figure 2:
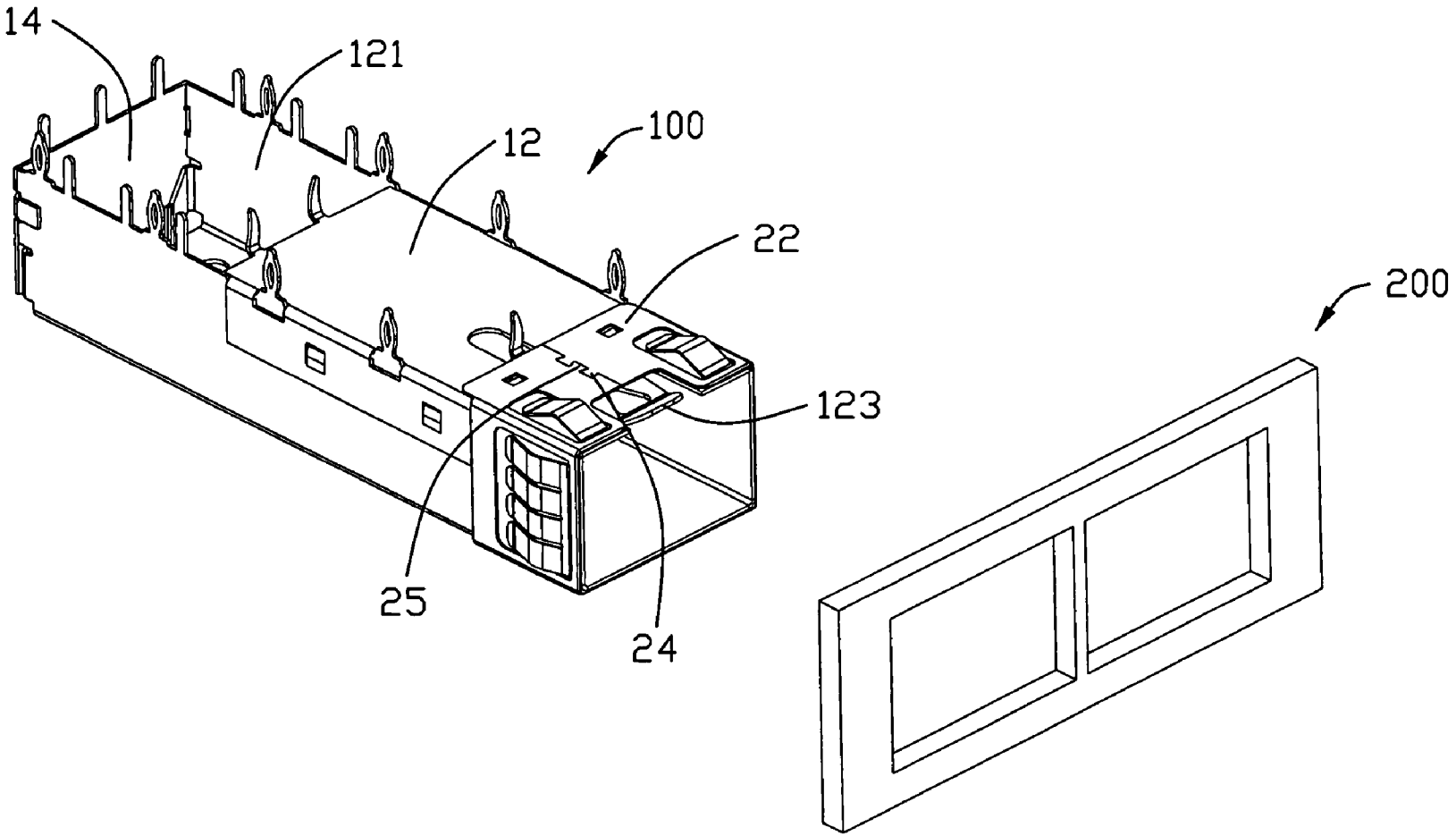
FIG. 2 is a view similar to FIG. 1 while taken from another aspect.
Figure 3:
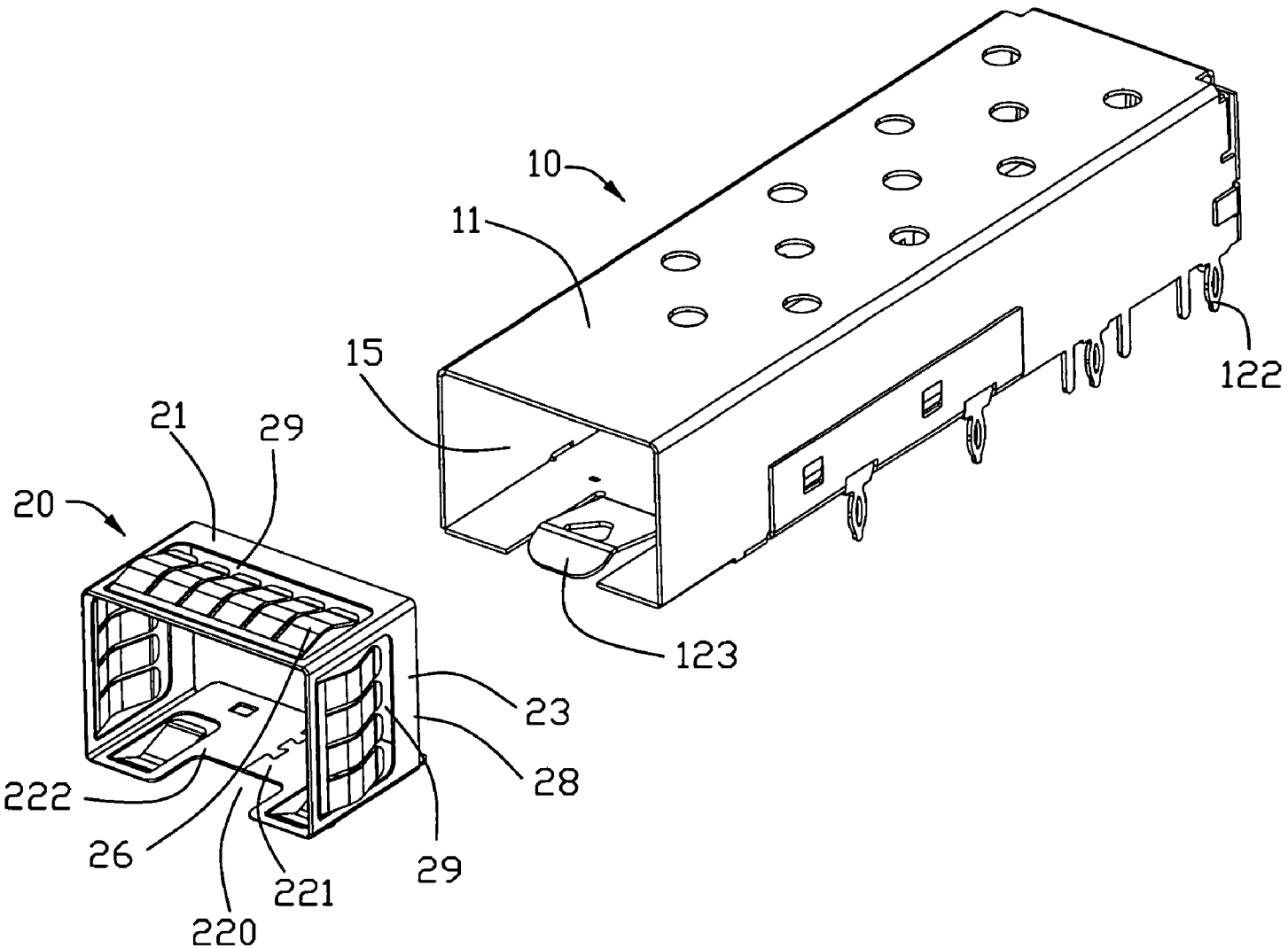
FIG. 3 is an exploded view of a receptacle cage as shown in FIG. 1.
Figure 4:
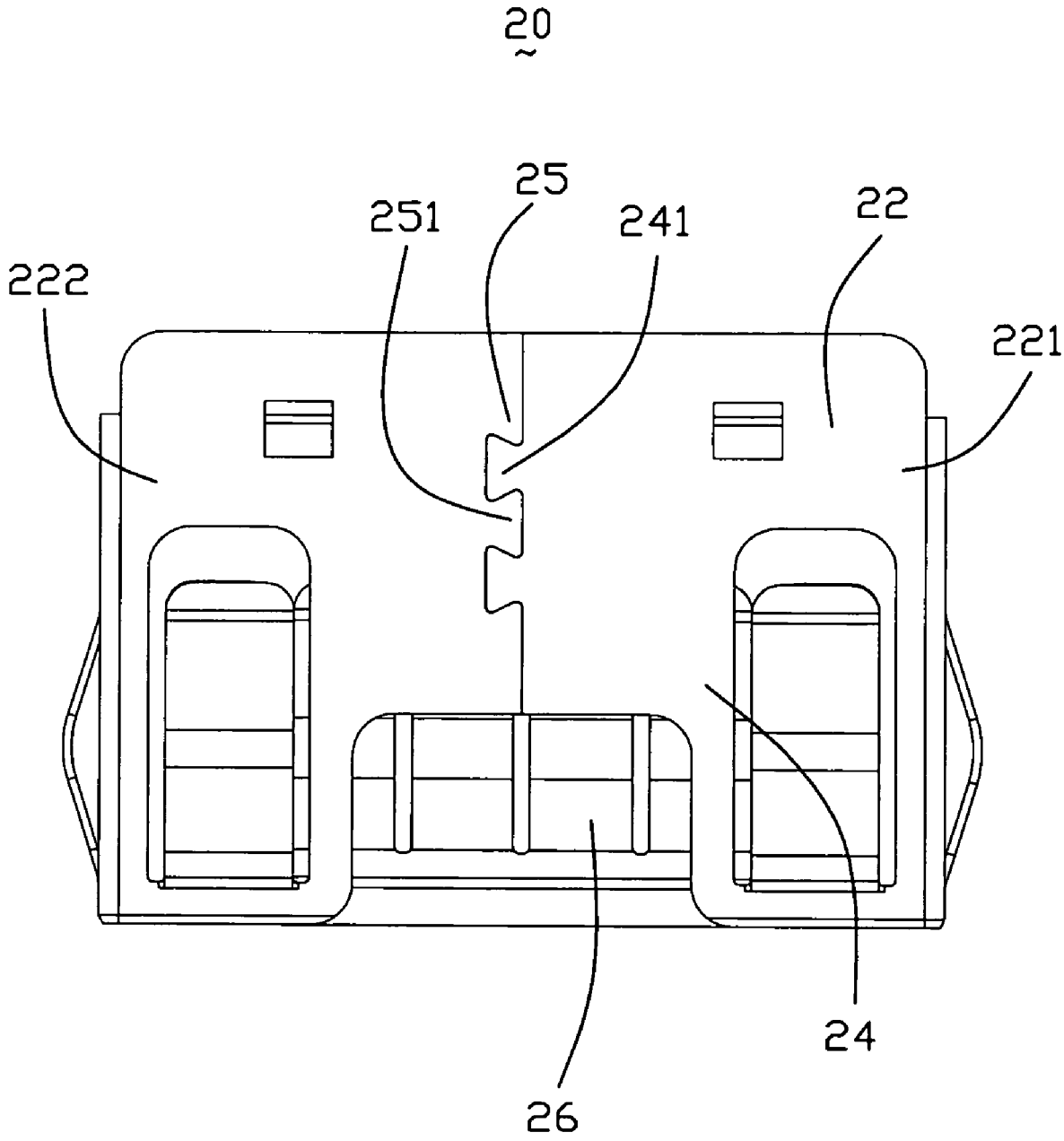
FIG. 4 is a bottom view of a cage body as shown in FIG. 3.
Figure 5:
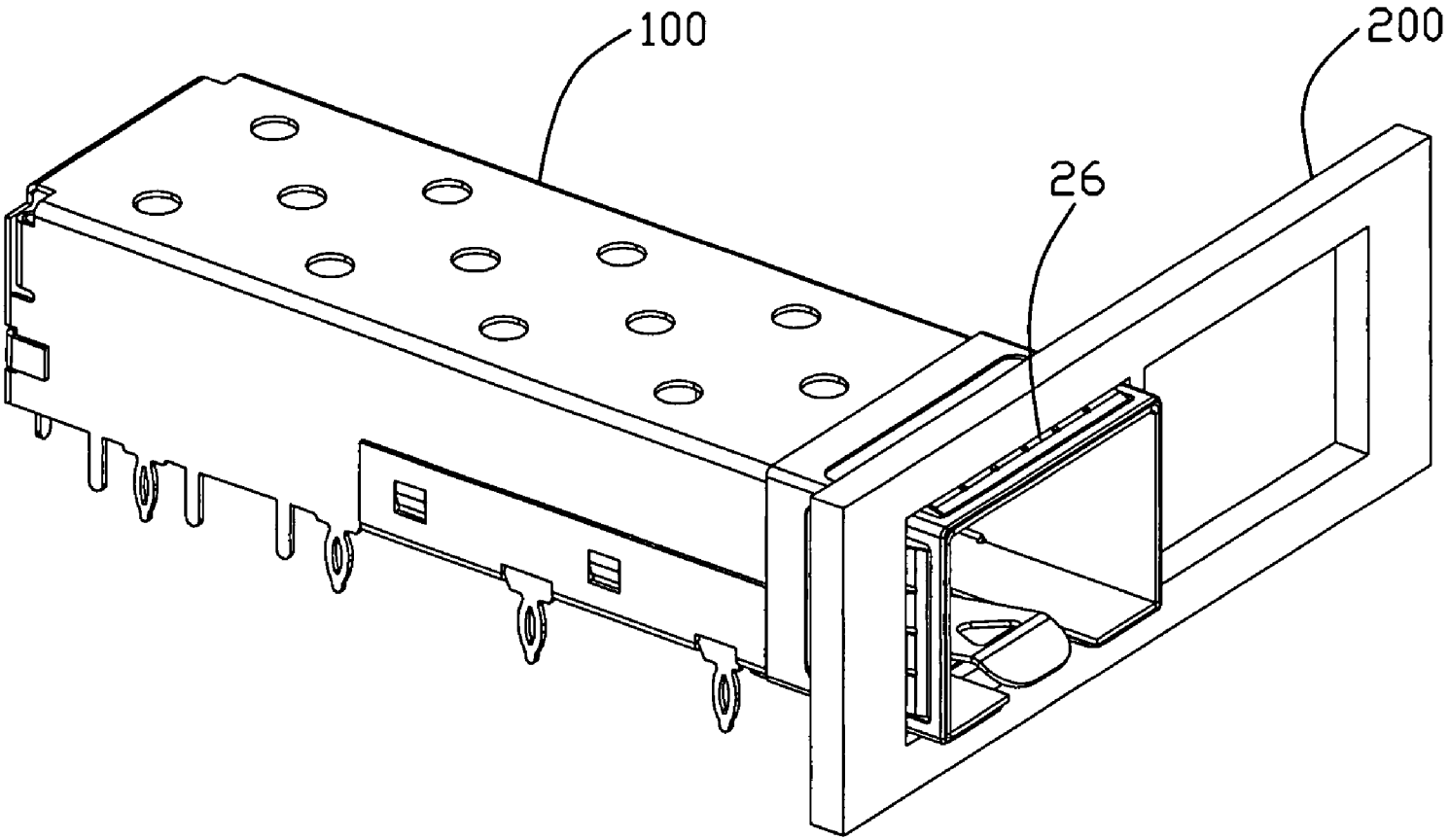
FIG. 5 is an assembled perspective view of the receptacle cage mounted into the chassis.

Reference will now be made to the drawing figures to describe the present invention in detail. Referring to FIGS. 1-5, a receptacle cage 100 mounted on a printed circuit board (not shown) for receiving an SFP transceiver (not shown) comprises a cage body 10 and a unitary, rectangular-shaped collar 20 mounted to a front portion of the cage body 10.

The cage body 10 has a top wall 11, a bottom wall 12 in parallel with the top wall 11, a pair of side walls 13, a rear wall 14 and a receiving opening 15 defined therebetween for receiving the SFP transceiver. The bottom wall 12 has a plurality of pins 122 extending downwardly therefrom for connecting with the printed circuit board, a recess 121 defined thereon and in communication with the receiving opening 15 and a spring plate 123 extending upwardly from the bottom wall 12.

The unitary, rectangular-shaped collar 20 is stamped from a sheet metal and attached onto the front portion of the cage body 10. The unitary, rectangular-shaped collar 20 has a top plate 21, a pair of opposite side plates 23 and a bottom plate 22. The bottom plate 22 comprises a first bottom plate half 221 having a first engaging portion 24 and a second bottom plate half 222 having a corresponding second engaging portion 25 coupling with the first engaging portion 24 for connecting the first bottom plate half 221 to the second bottom plate half 222. The first engaging portion 24 is formed with a pair of first protrusions 241 and a first receiving recess defined between the pair of first protrusions 241. The second engaging portion 25 is formed with a second protrusion 251 received in said first receiving recess. The bottom plate 22 further has a cutout 220 in communication with the receiving opening 15 for coupling with the spring plate 123.

Figure 6:
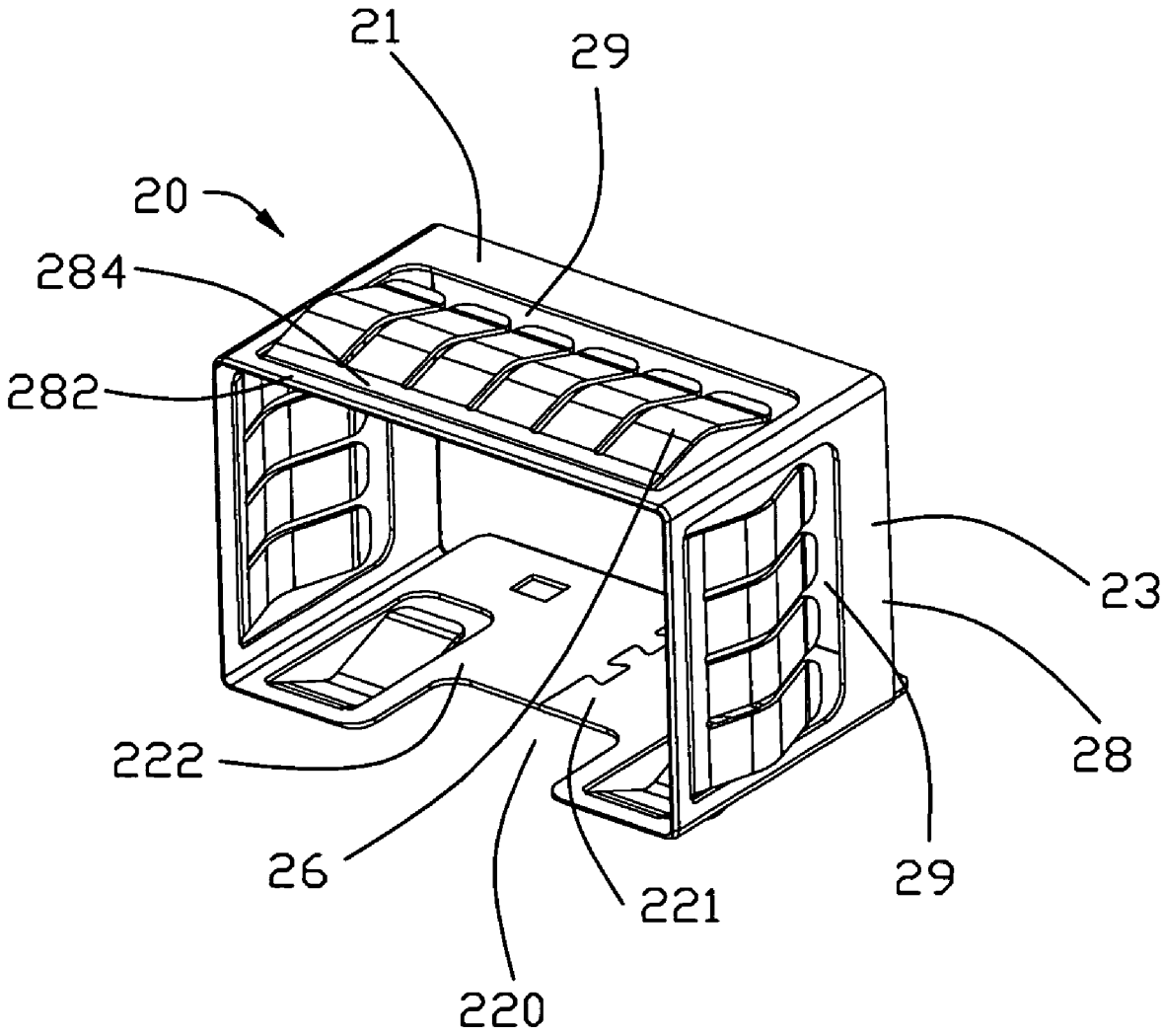
FIG. 6 is a perspective view of a rectangular-shaped collar of the receptacle cage show in FIG. 3.

The top plate 21 and the pair of side plates 23 of the unitary, rectangular-shaped collar 20 respectively has a plurality of resilient fingers 26, a base portion 28 and an opening 29. The resilient fingers 26 of the top plate 21 are arranged side by side in a first direction and rearwardly extend into the opening 29 for electrically contacting with a chassis 200 in which the conductive collar 20 is enveloped. The base portion 28 further includes a front edge portion 282 (referring to FIG. 6) adjacent to corresponding walls of the cage body 10 and a connection portion 284 extending slantways and rearwardly from the front edge portion 282. The connection portion 284 extends continuously in the first direction, so that the connection portion 282 makes the rectangular-shaped collar 20 more rigid and at the same time the resilient fingers 26 could interengage with the chassis 200 in good position. Outmost two of the resilient fingers 26 define a longer force arm on two opposite outer sides thereof in comparison with a shorter force arm defined by the remaining inner resilient fingers 26 so as to have the connection portion 284 with the associated resilient fingers 26 thereof performs resilience essentially wholly rather than individually.

During assembly, firstly, the first engaging portion 24 and the second engaging portion 25 are interconnected with each other by the interference fit between the second protrusion 251 and the two first protrusions 241. Secondly, the unitary, rectangular-shaped collar 20 is assembled to the cage body 10 firmly. Finally, the receptacle cage 100 mounted onto a printed board with the collar 20 snugly extends into a passage 201 defined on the chassis 200 thereby providing a robust EMI shielding thereof.

So a method for making a receptacle cage for a SFP transceiver is also-provided. The method comprises the following steps: (1) providing a cage body 10 having a plurality of walls 11, 12, 13, 14 to define an opening 15 for receiving the SFP transceiver therein, the cage body 10 having a front end to be inserted into a passage 201 defined in a chassis 200; (2) providing a rectangular-shaped collar 20, said rectangular-shaped collar 20 defined with a plurality of resilient fingers 26 for contacting the chassis 200 in said passage 201, said rectangular-shaped collar 20 having a plurality conductive plates 21, 23, 24, 25 bent from a planar metal plate, wherein said plurality conductive plates 21, 23, 24, 25 being connected in turn and two conductive plates 24, 25 at opposite ends of said plurality conductive plates being connected to form said rectangular-shaped collar 20; (3) sheathing said rectangular-shaped collar 20 around said front end of said cage body 10, wherein the rectangular-shaped collar 20 being fixed there.

It should be understood that the connection of the two conductive plate 24, 25 is realized through an interference engagement of the protrusions 241, 251, however, in other embodiment, the connection may be realized through welding.

It should also be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A receptacle cage mounted on a printed circuit board, comprising: a cage body having a plurality of walls to define an opening for receiving a small form-factor pluggable (SFP) transceiver therein, the cage body having a front end to be inserted into a passage defined in a chassis, and a conductive plate attached to an outside surface of the cage body at the front end, said conductive plate forming a plurality of resilient fingers for grounding said cage body to said chassis; wherein said conductive plate forming a front edge portion adjacent to one of the walls of the cage body, a connection portion extending at an acute angle and rearwardly from the front edge portion, and the plurality of resilient fingers being disposed side by side in a first direction and each extending from the connection portion, wherein said connection portion extends continuously in said first direction.

2. The receptacle cage as claimed in claim 1, wherein said conductive plate is punched from a metal plate, the connection portion and the plurality of resilient fingers being cut and bent from said metal plate.

3. The receptacle cage as claimed in claim 2, wherein the metal plate is formed into a unitary, rectangular-shaped collar comprising said conductive plate, said rectangular-shaped collar sheathing the front end of the cage body.

4. The receptacle cage as claimed in claim 3, wherein the conductive plate is set on a top wall of the cage body and forms a top plate, the rectangular-shaped collar further comprising a pair of opposite side plates and a bottom plate, said bottom plate comprising a first bottom plate half having a first engaging portion and a second bottom plate half having a corresponding second engaging portion coupling with the first engaging portion for connecting the first bottom plate half to the second bottom plate half.

5. The receptacle cage as claimed in claim 4, wherein either of the side plates forms a front edge portion closed to corresponding wall of the cage body, a connection portion extending at an acute angle and rearwardly from the front edge portion, and the plurality of resilient fingers being listed side by side in a second direction and extending continuously from the connection portion, wherein said connection portion extends continuously in the second direction.

6. The receptacle cage as claimed in claim 4, wherein said first engaging portion has a pair of first protrusions and a first receiving recess defined between the pair of first protrusions, and wherein the second engaging portion has a second protrusion interference fitted in said first receiving recess.

7. The receptacle cage as claimed in claim 4, wherein said bottom plate of the collar defines a cutout receiving a spring plate extending from said cage body.

8. The receptacle cage as claimed in claim 4, wherein said cage body has four sides walls, a rear wall and a receiving opening defined therebetween for receiving the SFP transceiver.

9. The receptacle cage as claimed in claim 4, wherein the bottom plate has a recess communicating with the receiving opening so that a connector can be mounted therein on said printed circuit board.

10. A method for making a receptacle cage comprising the following steps: providing a metallic cage body having a plurality of walls to define an opening for receiving a small form-factor pluggable (SFP) transceiver therein, the cage body having a front end to be inserted into a passage defined in a chassis; providing a rectangular-shaped collar, said rectangular-shaped collar defined with a plurality of resilient fingers for contacting the chassis in said passage, said rectangular-shaped collar having a plurality conductive side plates bent from a top planar metal plate, wherein said plurality conductive side plates being connected in turn by two conductive plates halves at opposite ends of said plurality conductive plates being physically connected to each other to form said rectangular-shaped collar; said rectangular-shaped collar surrounding said front end of said cage body, wherein the rectangular-shaped collar is retained there.

11. The method for making a receptacle cage as claimed in claim 10, wherein one of said plurality of conductive plates of said rectangular-shaped collar forming a front edge portion adjacent to one of the walls of the cage body, a connection portion extending at an acute angle and rearwardly from the front edge portion, and the plurality of resilient fingers being listed side by side in a first direction and each extending from the connection portion, and wherein said connection portion extends continuously in said first direction.

12. The method for making a receptacle cage as claimed in claim 10, wherein each of said two conductive plates at opposite ends of said plurality conductive plates forms a plurality of protrusions, the protrusions of one conductive plate interference mating with the protrusions of the other conductive plate so that said two conductive plates are connected to form a bottom conductive plate of the rectangular-shaped collar.

13. The method for making a receptacle cage as claimed in claim 10, wherein material of said collar is softer than that of the cage body so as to perform interference engagement between the collar and the cage body.

14. A receptacle cage mounted on a printed circuit board, comprising: a cage body having a plurality of walls to define an opening for receiving a small form-factor pluggable (SFP) transceiver therein, the cage body having a front end inserted into a passage defined in a chassis, and a conductive plate attached to an outside surface of the cage body at the front end, said conductive plate forming a plurality of resilient fingers for grounding said cage body to said chassis; wherein said conductive plate forming a front edge portion adjacent to one of the walls of the cage body, a connection portion extending at an acute angle and rearwardly from the front edge portion, and the plurality of resilient fingers being disposed side by side in a first direction and each extending from the connection portion, wherein outmost two of said fingers define a longer force arm on two opposite outer sides thereof in comparison with a shorter force arm defined by the remaining inner fingers so as to have said connection portion with the associated resilient fingers thereof perform resilience essentially wholly rather than individually.

* * * * *